US009484661B2

(12) United States Patent
Savla

(10) Patent No.: US 9,484,661 B2
(45) Date of Patent: Nov. 1, 2016

(54) ELECTRICAL CONNECTOR PROTECTION

(71) Applicant: Hamilton Sundstrand Corporation, Windsor Locks, CT (US)

(72) Inventor: Lalit Savla, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 0 days.

(21) Appl. No.: 14/612,396

(22) Filed: Feb. 3, 2015

(65) Prior Publication Data

US 2016/0226179 A1 Aug. 4, 2016

(51) Int. Cl.
*H01R 13/514* (2006.01)
*H01R 13/502* (2006.01)
*H01R 43/18* (2006.01)

(52) U.S. Cl.
CPC ..... *H01R 13/502* (2013.01); *H01R 43/18* (2013.01)

(58) Field of Classification Search
CPC .. H01R 23/7057; H01R 9/23; H01R 13/502; H01R 13/516
USPC ..... 439/736, 936
See application file for complete search history.

(56) References Cited

U.S. PATENT DOCUMENTS 3,824,524 A * 7/1974 Glover ..... H01R 13/62 439/282
3,923,362 A 12/1975 Dunn et al.
4,741,709 A 5/1988 Jervis
5,059,130 A 10/1991 Miller, Jr.
5,173,449 A * 12/1992 Lorenzen ..... H01L 21/28568 148/DIG. 20
5,357,057 A 10/1994 Debbaut
5,364,283 A * 11/1994 Katoh ..... H01R 13/5216 439/201
5,580,282 A * 12/1996 Paterek ..... H01R 13/521 439/271
6,132,251 A * 10/2000 Onoda ..... H01R 13/5216 439/587
6,149,456 A * 11/2000 Uchiyama ..... H01R 13/521 439/488
6,910,904 B2 * 6/2005 Herrick ..... F04B 39/121 439/271

FOREIGN PATENT DOCUMENTS

EP 0892467 A1 1/1999
WO 9714194 4/1997

OTHER PUBLICATIONS

Extended European Search Report, for European Patent Application No. 16154039.8, dated Jul. 6, 2016, 11 pages.

* cited by examiner

*Primary Examiner* — Phuong Dinh
(74) *Attorney, Agent, or Firm* — Kinney & Lange, P.A.

(57) ABSTRACT

An embodiment of an electrical connector assembly includes a shell, a plurality of fixed conductors, and a potting container. The shell includes a plurality of walls extending in a first direction from a base having at least one opening. The base and the plurality of walls define a shell outer surface and a shell inner surface. The shell inner surface bounds an inner volume of the shell and has an inner shell profile. The plurality of fixed conductors project through the opening into the inner volume of the shell. The potting container includes an outer surface complementing the shell inner profile, and a cavity receives the fixed conductors through a slot in the base. A potting compound fills the cavity such that the potting compound completely surrounds the conductors.

14 Claims, 5 Drawing Sheets

ELECTRICAL CONNECTOR PROTECTION

BACKGROUND

The disclosure relates generally to electronic devices and more specifically to methods and apparatus for protecting electrical connectors on such devices.

Connectors on electronic equipment, such as connectors on circuit boards for testing or data updates, only infrequently have a corresponding harness or other attachment during normal use. Thus such connectors are frequently conformal coated and potted directly in the connector shell, so as to keep out moisture and prevent corrosion of the pin contacts during use of the equipment.

But when it is time to perform testing, updates, or otherwise periodically attach a device to a connector configured for external test, repair, or update equipment, the connectors need to be free of the conformal coating. Once connectors are filled with potting compound, it is difficult and time consuming to remove when needed for access by the external device.

Further, the pin height inside the connector should be flush with the outer body of the connector. But after the connector shell is filled with uncured potting compound, the potting compound eventually shrinks, and this results in exposure of the pin tips to environmental hazards. In addition, a number of connectors, such as open-header type connectors, do not have a shell or other enclosure. It is not possible to protect the pins by conventional potting because there is nothing to retain the potting compound in the connector shell either during or after cure.

SUMMARY

An embodiment of an electrical connector assembly includes a shell, a plurality of fixed conductors, and a potting container. The shell includes a plurality of walls extending in a first direction from a base having at least one opening. The base and the plurality of walls define a shell outer surface and a shell inner surface. The shell inner surface bounds an inner volume of the shell and has an inner shell profile. The plurality of fixed conductors project through the opening into the inner volume of the shell. The potting container includes an outer surface complementing the shell inner profile, and a cavity receives the fixed conductors through a slot in the base. A potting compound fills the cavity such that the potting compound completely surrounds the conductors.

An embodiment of an electrical connector assembly includes a plurality of conductors projecting from a base, and a potting container. The potting container includes an outer surface. A cavity receives the fixed conductors through a slot in a base of the potting container. A potting compound fills the cavity and surrounds the fixed conductors.

An embodiment of a method includes removing a potting container from an electrical connector having a plurality of fixed electrical conductors. The potting container includes a base and a plurality of walls which together define an outer surface, a textured inner surface, and a cavity, with a potting compound filling the cavity. The potting container also includes an opening for receiving the plurality of fixed conductors through a slot in a base of the potting container. After removal, an external data device is connected to the electrical connector. At least one procedure is performed which includes communicating data between the external data device and the electronic device.

DETAILED DESCRIPTION

Figure 1:
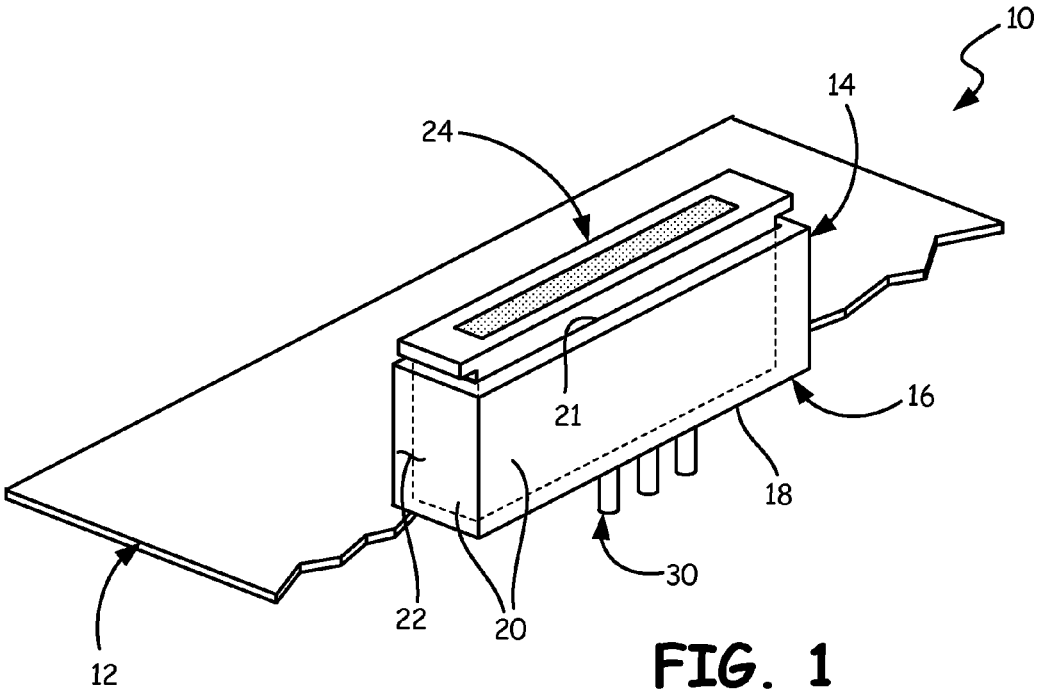
FIG. 1 is a perspective view of a removable potting container engaged within a closed header-type connector.

FIG. 1 shows an electronic assembly 10, including substrate 12 and header type fixed connector assembly 14. Electronic assembly 10 can be any electronic apparatus with fixed electrical connector assembly 14 and one or more other elements (not shown) mounted to substrate 12. Generally, fixed connector assembly 14 includes shell 16 with base 18 having a plurality of walls 20 and at least one opening 21 (best seen in FIG. 2). Walls 20 extend a first direction from base 18 such that base 18 and walls 20 define opening 21, shell outer surface 22, and a shell inner surface (shown in FIGS. 2 and 3A-3B).

Potting container 24 is retained in fixed connector shell 16. Fixed electrical connector assembly 14 can be provided to communicate only periodically with an external device (See, e.g., FIG. 3B) via fixed conductors 30. However, during normal use, electronic assembly 10 does not have any external attachments connected to fixed connector assembly 14. Generally, fixed connector assembly 14 could be but is not limited to a test or repair port for electronic assembly 10, and is typically accessed when assembly 10 is otherwise not in use. To ensure that fixed conductors 30 are protected from moisture or other contaminants until fixed connector assembly 14 is to be accessed, potting container 24 is retained in connector shell 16.

Figure 2A:
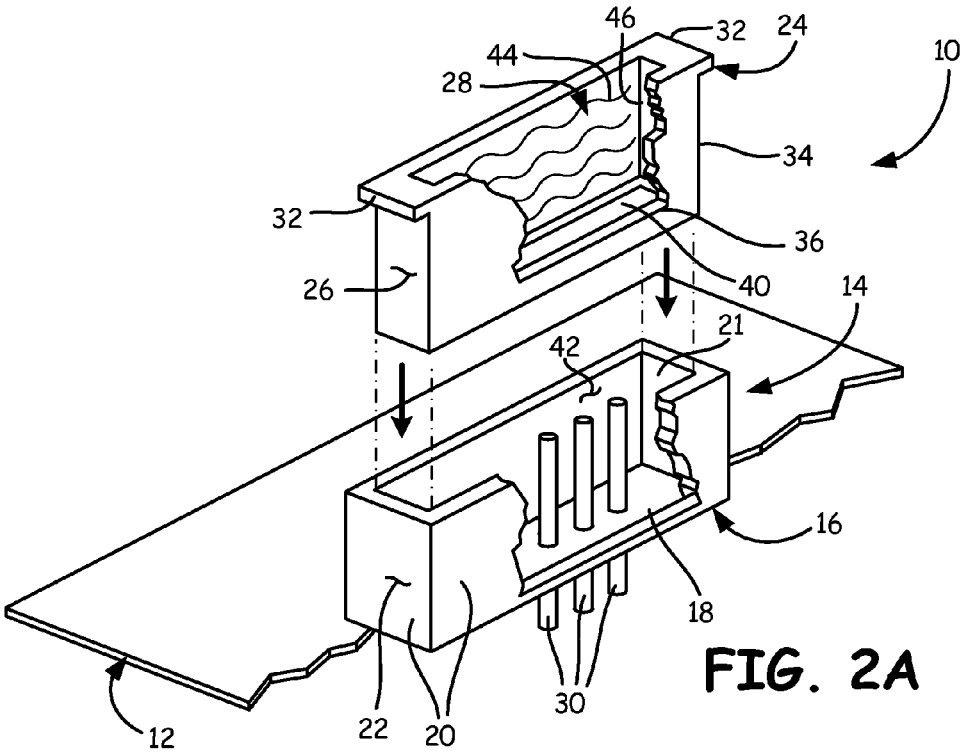
FIG. 2A shows an exploded view of the removable potting container being inserted into the closed header-type connector.
Figure 2B:
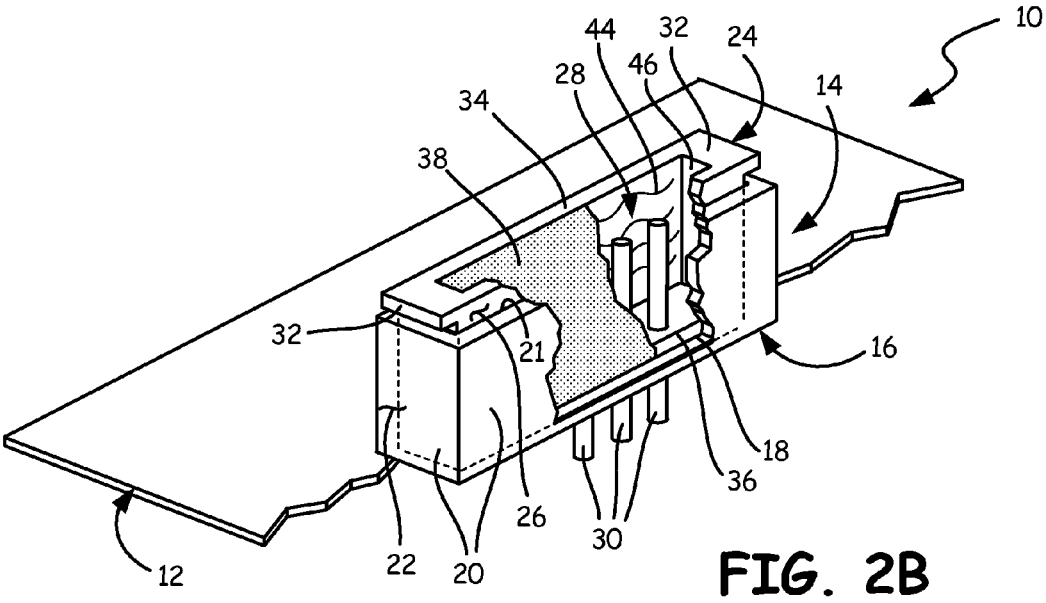
FIG. 2B is a cutaway view of potting material added to the potting container and connector shown in FIG. 2A.
Figure 3A:
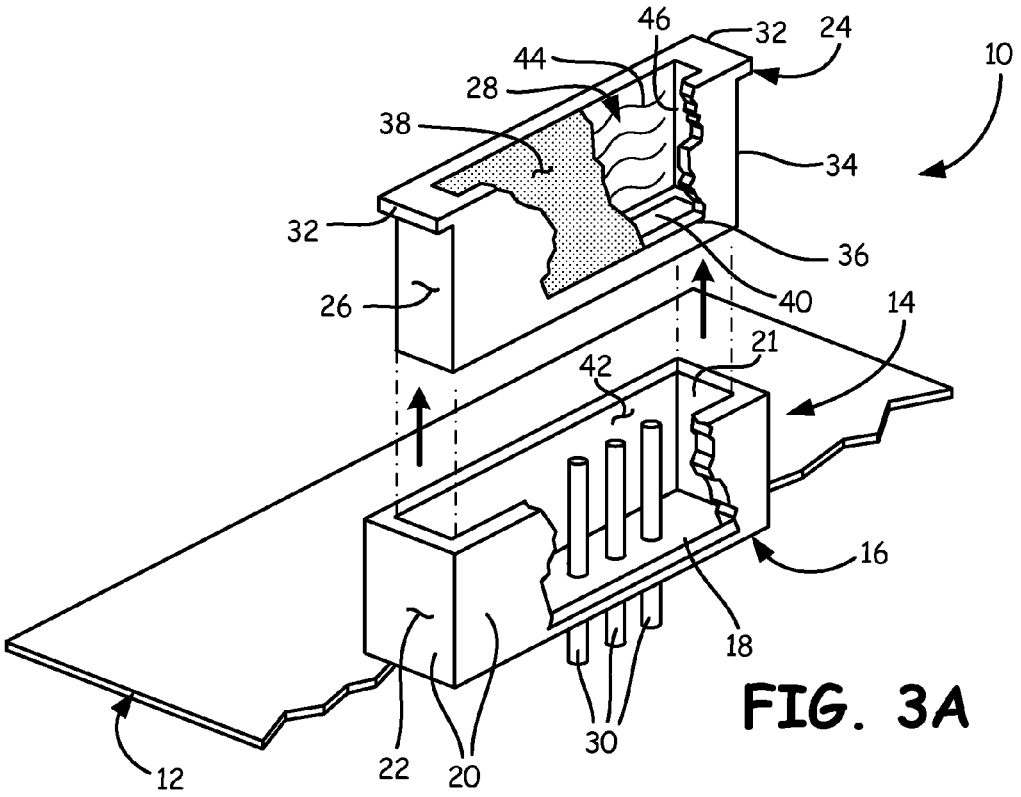
FIG. 3A shows an exploded view of the potting container and compound being removed from the closed header-type connector.

FIG. 2A shows potting container 24 received in fixed connector shell 16 via shell opening 21. Potting container 24 can include outer surface 26, as well as cavity 28, which receives fixed conductors 30. Potting container 24 can also include one or more removal tabs 32 disposed around edges of potting container shell 34. Fixed conductors 30 pass through base 36 of potting container 24 into container cavity 28. Slot 40 can be formed in base 36 of potting container 24 for fixed conductors 30 to pass through into container cavity 28. A surface profile of potting container outer surface 26 can complement a profile of a shell inner surface 42 so that potting container 24 is readily received in fixed connector shell 16. Potting container 24 can also optionally include textured inner surface 44 and/or one or more wall portions 46 with a nonzero draft angle. These can simplify removal as shown with respect to FIG. 3A FIG. 2B shows electronic assembly 10 and substrate 12 with potting container 24 installed to protect connector assembly 14. Portions of structures have been cut away for purposes of clarity. Once container 24 is installed in place, potting compound 38 can be added to fill container cavity 28 so as to surround and protect fixed conductors 30. In this example, fixed conductors 30 are shrouded (via walls 20 of fixed connector shell 16). Embodiments of a potting container can protect unshrouded fixed conductors as described with respect to subsequent figures. Potting compound 38, in certain embodiments, can include RTV silicone, but can additionally or alternatively include one or more other suitable protective potting compounds.

FIG. 3A is an exploded view of potting container 24 and potting compound being removed from fixed connector assembly 14 and conductors 30. Removal tabs 32, which can project above and/or out from connector shell 16 and opening 21, assist with rapid and nearly complete removal of potting container 24 along with potting compound 38. To further simplify removal of potting compound 38 from fixed conductors 30, potting container 24 can include a textured inner surface 44. The textured inner surface 44 provides ridges, bumps, recesses, and other additional surface area to grip and more completely remove potting compound 38. Additionally and/or alternatively, one or more portions 46 of potting container inner surface 44 can have a nonzero draft angle so that potting compound 38 can be more completely removed from conductors 30.

Figure 3B:
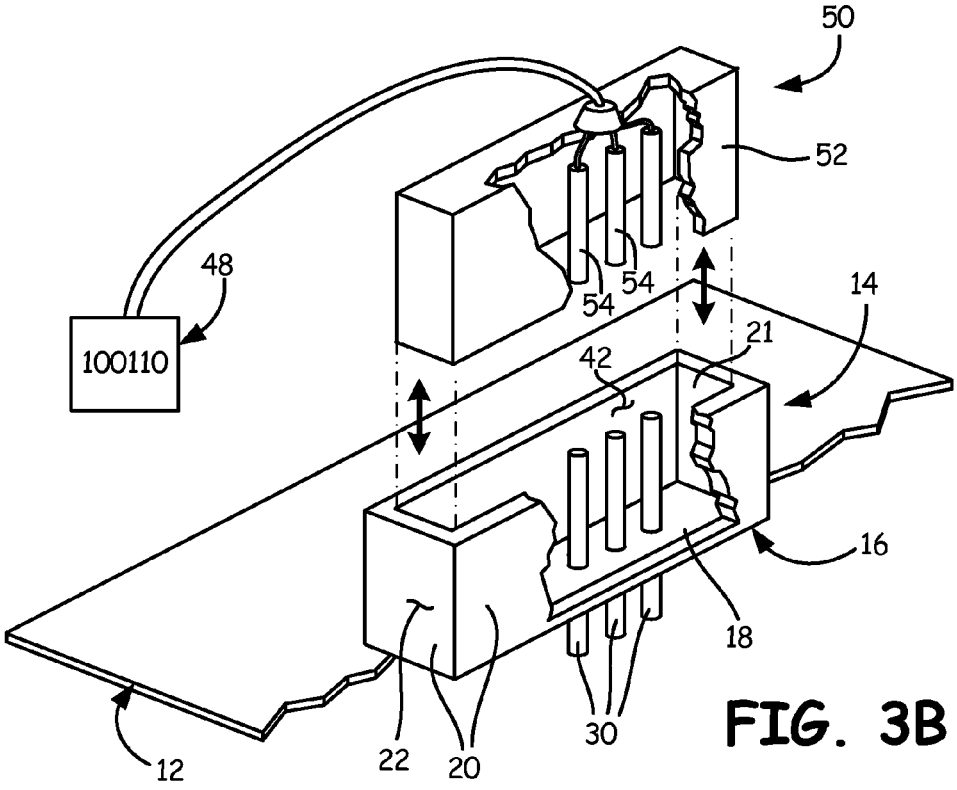
FIG. 3B shows an exploded view of an external device being attached to the closed header-type connector after removal of the potting container and compound.

FIG. 3B is an exploded view of fixed connector assembly 14 and external device 48. With the exploded view shown in FIG. 3B, an external device 48 is shown with mating connector assembly 50. Mating connector assembly 50 is provided for connection to (and removal from) fixed connector assembly 14. When potting container 24 has been removed from (or before initial installation on) fixed connector assembly 14, mating connector shell 52 and complementary conductors (e.g., receptacles) 54 can respectively engage connector shell 16 and fixed conductors 30.

Example device 48 can include but is not limited to items such as a handheld tester, portable computer, tablet, and/or smartphone (via suitable attachment with mating connector assembly 50). For example, one or more external devices 48 can be programmed to interface with electronic assembly 10 via connector assembly 14 to test, update, download, or otherwise communicate data to and from electronic assembly 10.

Figure 4:
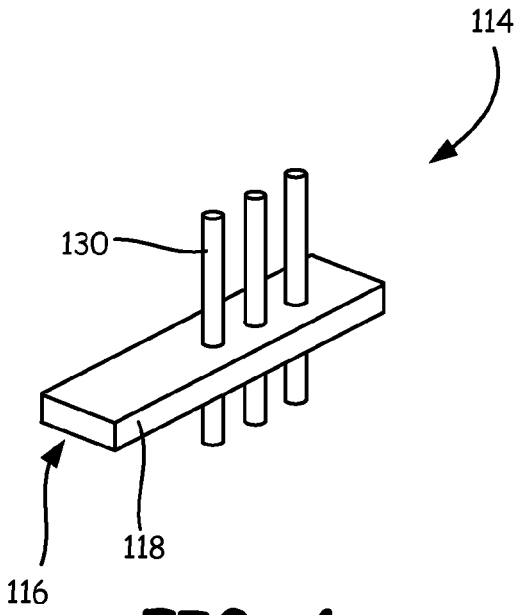
FIG. 4 shows an open header-type connector.
Figure 5:
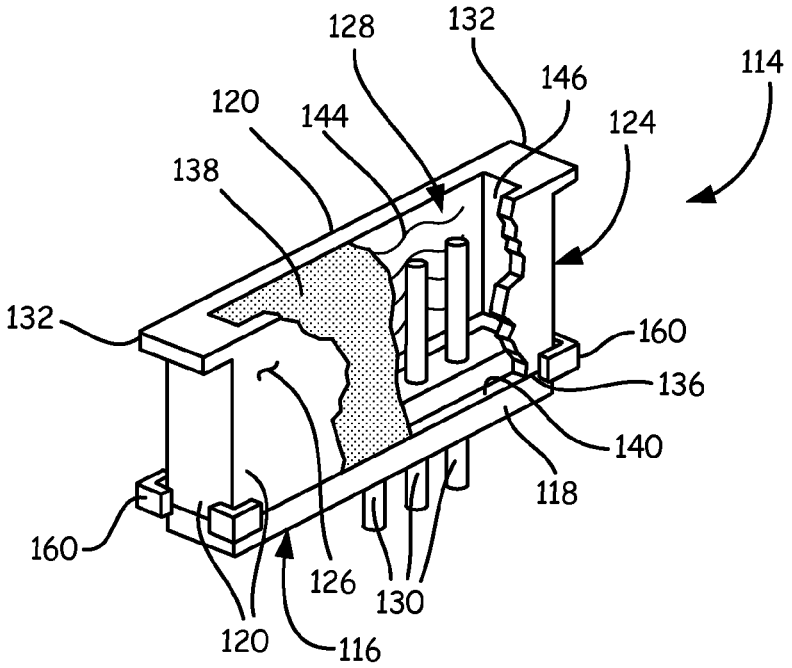
FIG. 5 includes a removable potting container and potting compound with the open header-type connector of FIG. 4.

FIG. 4 shows an alternate embodiment with open header type connector 114. FIG. 5 includes potting container 124 disposed over fixed connector 114. Similar to the preceding example of a closed header fixed connector 14 (shown in FIGS. 1-3B), FIG. 4 has open header type fixed connector 114 with a plurality of unshrouded fixed conductors (e.g., pins) 130 projecting from base 118 of fixed connector shell 116. Here, unlike the first example embodiment, shell 116 is not enclosed and does not include a full complement of shell sidewalls to form an enclosed cavity about fixed conductors 130. As such, there is no structure on connector 114 to readily retain a potting material for protecting fixed conductors 130.

FIG. 5 shows potting container 124 tailored to protect open header type connector 114 and unshrouded fixed conductors 130. Elements include walls 120 which define outer container surfaces 126 and potting cavity 128. Potting cavity 128 receives fixed conductors 130 through container slot 140 in potting container base 136. Potting compound 138 (e.g., RTV silicone) can fill cavity 128 and surround conductors 130. A portion of potting compound 138 is also cut away for clarity.

Also similar to the first example embodiment, potting container 124 can include a plurality of removal tabs 132 (which may extend above fixed conductors 130) and can have a textured inner surface 144 to better interface with potting compound 138. One or both of these elements can further improve rapid and efficient removal of potting compound 138 from fixed conductors 130. When conductors fixed 130 are unshrouded as in FIGS. 4 and 5, potting container 124 protects fixed conductors 130 while remaining removable due to a textured surface profile 144. Additionally and/or alternatively, one or more portions 146 of inner surface 144 can have a nonzero draft angle so that potting compound 138 can be more completely removed from conductors 130. FIG. 5 also shows container base 136 which can optionally include interference protrusions or snaps 160 shaped to engage open header base 118. These are best seen in FIG. 6.

It will be noted that once potting container is removed, one or more external devices (e.g., device 48 shown in FIG. 3B) can be attached to fixed connector 114 for communication, test, and/or repair purposes as described above. However, the external device is omitted from FIGS. 4 and 5 for purposes of clarity.

Figure 6:
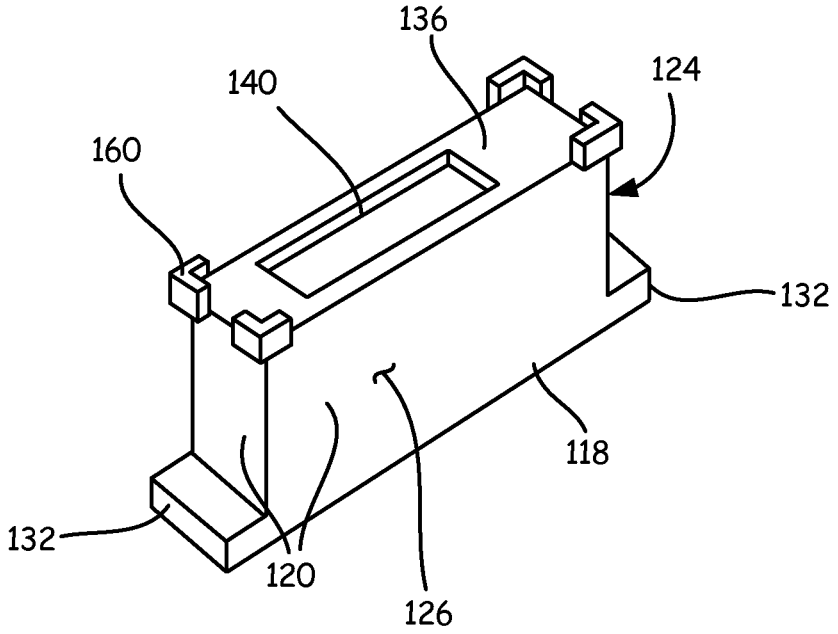
FIG. 6 shows a bottom view of the removable potting container for the open header-type connector of FIG. 4.

FIG. 6 shows an inverted view of potting container 124 to better illustrate protrusions 160 adapted to engage open header base 118. By placing protrusions or snaps 160 at multiple corners of container base 136, container slot 140 can center around conductors 130 (shown in FIG. 5) on open header base 118, thereby snapping it into place. The four corner protrusions 160 can help ensure that fixed conductors 130 are centered inside container slot 140 prior to addition of potting compound 138.

As noted above, a number of connectors are used in testing, repairing, or otherwise only periodically interfacing with an external electronic device. To perform a method with one or more external devices, a potting container can be removed from a fixed electrical connector having a plurality of electrical conductors (e.g., as shown in FIGS. 1-4). The potting container can include a base and a plurality of walls together defining an outer surface, a textured inner surface, and a cavity. There is an opening for receiving the fixed connectors through a slot in a base of the potting container. A potting compound fills the cavity so as to cover otherwise exposed fixed conductors of the fixed electrical connector.

Once potting container is removed, one or more external devices can be attached to the electrical connector. The external device(s) can be one or more devices such as those non-limiting examples referenced with respect to FIG. 3B (e.g., handheld tester, portable computer, tablet, smartphone, or the like). The device(s) can be programmed to interface with an electronic assembly via the fixed connector assembly to test, update, download, or otherwise communicate data to and from electronic assembly. After connecting each of the one or more external devices, at least one communication, test, and/or repair procedure can be initiated.

Upon completion of these procedure(s) using the same external device(s), the potting container can be replaced on the fixed electrical connector. This may be the same potting container or a second, substantially equivalent replacement potting container.

As also described, this method can work with both open and closed header type fixed connectors to protect shrouded or unshrouded fixed conductors from moisture when the electronic assembly is otherwise in use. Access can be provided by quickly removing the potting container which leaves little or no potting compound on the fixed conductors. This expedites the overall procedure utilizing the external device(s) because there is greatly reduced need to clean the conductors of excess potting compound, which ensures good contact and resultant data and/or power communication.

Discussion of Possible Embodiments

The following are non-exclusive descriptions of possible embodiments of the present invention.

An embodiment of an electrical connector assembly includes a shell, a plurality of fixed conductors, and a potting container. The shell includes a plurality of walls extending in a first direction from a base having at least one opening. The base and the plurality of walls define a shell outer surface and a shell inner surface. The shell inner surface bounds an inner volume of the shell and has an inner shell profile. The plurality of fixed conductors project through the opening into the inner volume of the shell. The potting container includes an outer surface complementing the shell inner profile, and a cavity receives the fixed conductors through a slot in the base. A potting compound fills the cavity such that the potting compound completely surrounds the conductors.

The electrical connector assembly of the preceding paragraph can optionally include, additionally and/or alternatively, any one or more of the following features, configurations and/or additional components:

A fixed electrical connector assembly according to an exemplary embodiment of this disclosure, among other possible things includes a shell comprising a base including at least one opening; and a plurality of walls extending in a first direction from the base, the base and the plurality of walls defining a shell outer surface and a shell inner surface, the shell inner surface bounding an inner volume of the shell and having a shell inner profile; a plurality of fixed conductors projecting through the opening into the inner volume of the shell; and a potting container including an outer surface complementing the shell inner profile, a cavity receiving the fixed conductors through a slot in the base, and a potting compound filling the cavity such that the potting compound completely surrounds the fixed conductors.

A further embodiment of the foregoing assembly, wherein the potting compound comprises RTV silicone.

A further embodiment of any of the foregoing assemblies, wherein the potting container includes a plurality of removal tabs.

A further embodiment of any of the foregoing assemblies, wherein at least one of the tabs projects above the shell.

A further embodiment of any of the foregoing assemblies, wherein the potting container include a textured inner surface.

An embodiment of an electrical connector assembly includes a plurality of conductors projecting from a base, and a potting container. The potting container includes an outer surface. A cavity receives the fixed conductors through a slot in a base of the potting container. A potting compound fills the cavity and surrounds the fixed conductors.

The electrical connector assembly of the preceding paragraph can optionally include, additionally and/or alternatively, any one or more of the following features, configurations and/or additional components:

An electrical connector assembly according to an exemplary embodiment of this disclosure, among other possible things includes a connector base; and a plurality of fixed conductors projecting from the connector base; and a potting container including an outer surface, and a cavity receiving the fixed conductors through a slot in a base of the potting container; and a potting compound filling the cavity and surrounding the fixed conductors.

A further embodiment of the foregoing assembly, wherein the fixed conductors are unshrouded.

A further embodiment of any of the foregoing assemblies, wherein the potting container includes a plurality of protrusions extending from the container base, the protrusions adapted to engage the connector base.

A further embodiment of any of the foregoing assemblies, wherein the potting container includes a plurality of removal tabs.

A further embodiment of any of the foregoing assemblies, wherein the potting container include a textured inner surface.

An embodiment of a method includes removing a potting container from an electrical connector having a plurality of fixed electrical conductors. The potting container includes a base and a plurality of walls which together define an outer surface, a textured inner surface, and a cavity, with a potting compound filling the cavity. The potting container also includes an opening for receiving the plurality of fixed conductors through a slot in a base of the potting container. After removal, an external data device is connected to the electrical connector. At least one procedure is performed which includes communicating data between the external data device and the electronic device.

The method of the preceding paragraph can optionally include, additionally and/or alternatively, any one or more of the following features, steps, configurations and/or additional components:

An electrical connector assembly according to an exemplary embodiment of this disclosure, among other possible things includes: removing a first potting container from a fixed electrical connector having a plurality of fixed conductors, the first potting container comprising a base and a plurality of walls together defining an outer surface, a textured inner surface, and a cavity; the base having an opening for receiving the plurality of fixed conductors through a slot in a base of the potting container; connecting an external device to the electrical connector via at least one of the plurality of conductors; and performing at least one procedure which includes communicating data between the external device and the electrical connector via at least one of the plurality of fixed conductors.

A further embodiment of the foregoing method, further comprising after the performing step, securing a second potting container over the electrical connector.

A further embodiment of any of the foregoing methods, wherein the second potting container is a replacement potting container.

A further embodiment of any of the foregoing methods, wherein the electrical connector is an open header type.

A further embodiment of any of the foregoing methods, wherein the at least one procedure includes a test procedure.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fixed electrical connector assembly comprising:

a shell comprising:

a base including at least one opening; and a plurality of walls extending in a first direction from the base, the base and the plurality of walls defining a shell outer surface and a shell inner surface, the shell inner surface bounding an inner volume of the shell and having a shell inner profile;

a plurality of fixed conductors projecting through the opening into the inner volume of the shell; and a potting container including an outer surface complementing the shell inner profile, a cavity receiving the fixed conductors through a slot in a base of the potting container, and a potting compound filling the cavity such that the potting compound completely surrounds the fixed conductors;

wherein the potting compound is substantially removed from all of the plurality of fixed conductors upon removal of the potting container from the electrical connector assembly.

2. The assembly of claim 1, wherein the potting compound comprises RTV silicone.

3. The assembly of claim 1, wherein the potting container includes a plurality of removal tabs.

4. The assembly of claim 3, wherein at least one of the tabs projects above the shell.

5. The assembly of claim 1, wherein the potting container include a textured inner surface.

6. An electrical connector assembly comprising:

a connector base; and a plurality of fixed conductors projecting from the connector base; and a potting container including an outer surface, and a cavity receiving the fixed conductors through a slot in a base of the potting container; and a potting compound filling the cavity and surrounding the fixed conductors;

wherein the potting container includes a plurality of protrusions extending from the base of the potting container, the protrusions adapted to engage the connector base.

7. The assembly of claim 6, wherein the fixed conductors are unshrouded.

8. The assembly of claim 6, wherein the potting container includes a plurality of removal tabs.

9. The assembly of claim 6, wherein the potting container include a textured inner surface.

10. A method comprising:

removing a first potting container from a fixed electrical connector having a plurality of fixed conductors, the first potting container comprising:

a base and a plurality of walls together defining an outer surface, a textured inner surface, and a cavity; the base having an opening for receiving the plurality of fixed conductors through a slot in a base of the potting container;

connecting an external device to the electrical connector via at least one of the plurality of conductors; and performing at least one procedure which includes communicating data between the external device and the electrical connector via at least one of the plurality of fixed conductors.

11. The method of claim 10, further comprising:

after the performing step, securing a second potting container over the electrical connector.

12. The method of claim 11, wherein the second potting container is a replacement potting container.

13. The method of claim 10, wherein the electrical connector is an open header type.

14. The method of claim 10, wherein the at least one procedure includes a test procedure.

* * * * *